United States Patent [19]

Rowe

[11] Patent Number: 4,936,562

[45] Date of Patent: Jun. 26, 1990

[54] METHOD AND APPARATUS FOR CONTROLLING A COLLATOR

[75] Inventor: Thomas A. Rowe, North Ridgeville, Ohio

[73] Assignee: AM International Incorporated, Chicago, Ill.

[21] Appl. No.: 56,466

[22] Filed: May 29, 1987

[51] Int. Cl.[5] ..... B65H 43/02

[52] U.S. Cl. ..... 270/56; 270/58; 270/59

[58] Field of Search ..... 270/54–56, 270/58, 59

[56] References Cited

U.S. PATENT DOCUMENTS

| | | | |
|---|---|---|---|
| 3,519,264 | 7/1970 | Beacham et al. | 270/54 |
| 3,525,516 | 8/1970 | Bushnell et al. | 270/54 |
| 3,578,310 | 5/1971 | Carson, Jr. | 270/54 |
| 3,593,065 | 7/1971 | Domalski et al. | 317/124 |
| 3,684,890 | 8/1972 | Hayne et al. | 250/223 |
| 3,702,187 | 11/1972 | Hageman et al. | 271/9 |
| 3,815,895 | 6/1974 | Dufour | 270/56 |
| 3,825,247 | 7/1974 | Fernandez-Rana et al. | 270/58 |
| 3,902,708 | 9/1975 | Wise et al. | 270/58 |
| 3,924,846 | 12/1975 | Reed | 270/56 |

*Primary Examiner*—Robert E. Garrett
*Assistant Examiner*—Therese M. Newholm
*Attorney, Agent, or Firm*—Tarolli, Sundheim & Covell

[57] ABSTRACT

A method and apparatus are disclosed for establishing a random fault limit for hoppers in a collating machine. A plurality of hoppers are arranged in an array, each adapted to feed signatures, one at a time, to a conveyor. A miss feed base number and a double feed base number is established in a microcomputer for each of the hoppers equal to either (i) a predetermined number of signature feeds by that hopper, (ii) a predetermined number of books assembled, or (iii) a predetermined number of collator machine cycles. A miss feed fault number and a double feed number is established in the microcomputer for each of the hoppers. Each hopper has an associated miss feed detector and a double feed detector electrically connected to the microcomputer. The microcomputer (i) monitors each of the detectors, (ii) counts the number of miss feeds or double feeds for each hopper, (iii) compares the number of miss feeds and double feeds for each hopper against its associated base number, (iv) determines whether the number of detected miss feeds or double feeds exceed their associated base number, and (v) warns an operator if it is determined that the detected number of miss feeds or double feeds does exceed their respective established base number for any of the hoppers.

9 Claims, 10 Drawing Sheets

METHOD AND APPARATUS FOR CONTROLLING A COLLATOR

Technical Background

The present invention relates to collating machines and is particularly directed to a method and apparatus for controlling a collator.

Background Art

The use of collators or gathering devices for assembling of a plurality of different signatures into assemblages, such as magazines or books, is well known in the art. Electronic controllers for collators are also known in the art. One example of an electronically controlled collator is described in U.S. Pat. No. 3,924,846 to Reed.

The Reed '846 patent describes a collator having a plurality of hoppers, each of which feed different signatures to a passing conveyor to form assemblages. The collator includes a plurality of raceway jam detection switches. The switches are mounted at spaced apart locations along the path of the conveyor, one switch located between alternate hoppers. When a jam occurs, i.e., a signature is incorrectly positioned on the conveyor, the signature causing the jam trips a jam detection switch. The electronic controller detects the jam switch trip and tracks the progress of the conveyor feed location where the jam occurred. The electronic controller not only rejects the assemblage at the feed location where the jam occurred, but also rejects one or more assemblages in feed locations upstream and/or downstream from the feed location where the jam occurred in accordance with a preselected reject pattern. Also, the electronic controller of the Reed '846 patent inhibits downstream hoppers from feeding signatures into feed locations which are to be rejected in accordance with the preselected reject pattern.

The collator disclosed in the '846 patent also includes means for detecting a hopper feed malfunction. The detector senses when a signature has not been fed by a hopper and also senses when more than one signature has simultaneously been fed from a hopper. Such feed malfunctions are known in the art as a miss or a double feed, respectively.

It is desirable to have a collator control that permits a certain amount of hopper, random feed errors but that monitors the number of feed errors per a preselected base number. It is also desirable to set differing, random feed limits per preselected base number depending upon the hopper's position within the collator and also upon the particular signature the hopper is feeding.

Brief Summary of the Invention

The present invention provides a new method and apparatus for controlling a collator. In particular, the present invention provides a method and apparatus for monitoring each hopper for the occurrence of random, incorrect signature feeds and for determining if the number of incorrect signature feeds for any one hopper exceeds a predetermined base number of signature feeds for that hopper.

In accordance with the present invention, an apparatus for controlling a collator is provided having a plurality of hoppers adapted for feeding signatures onto a movable conveyor, the conveyor having a plurality of signature feed locations sequentially movable past said hoppers for receiving signatures fed from the hoppers to form assemblages. The apparatus comprises means for establishing a value for an incorrect feed limit over a predetermined base number of signature feeds for each of the hoppers. The apparatus further comprises means for sensing an incorrect feed of a signature from one of the hoppers and for generating a signal indicative thereof. Means is provided for determining if the number of sensed incorrect signature feeds has reached the established incorrect signature feed limit within the predetermined base number of signature feeds for each of the hoppers. The apparatus further comprises means for providing an indication to an operator when the determining means determines that the limit has been reached.

A method, in accordance with the present invention, controls a collator having a plurality of hoppers adapted for feeding signatures onto a movable conveyor. The conveyor has a plurality of signature feed locations sequentially movable past the hoppers for receiving signatures fed from the hoppers to form assemblages. The method comprises the steps of establishing a value for an incorrect feed limit over a predetermined base number of signature feeds for each of the hoppers and sensing an incorrect feed of a signature from one of the hoppers and generating a signal indicative thereof. The method of the present invention further comprises the steps of determining if the number of sensed incorrect signature feeds has reached the established incorrect signature feed limit within the predetermined base number of signature feeds for each of the hoppers, and providing an indication to an operator when it is determined that the limit has been reached.

Brief Description of the Drawings

Other objects and features of the invention will become apparent to those skilled in the art upon reading and understanding the detailed description taken in conjunction with the accompanying drawings wherein.

Description of a Preferred Embodiment

Figure 1:
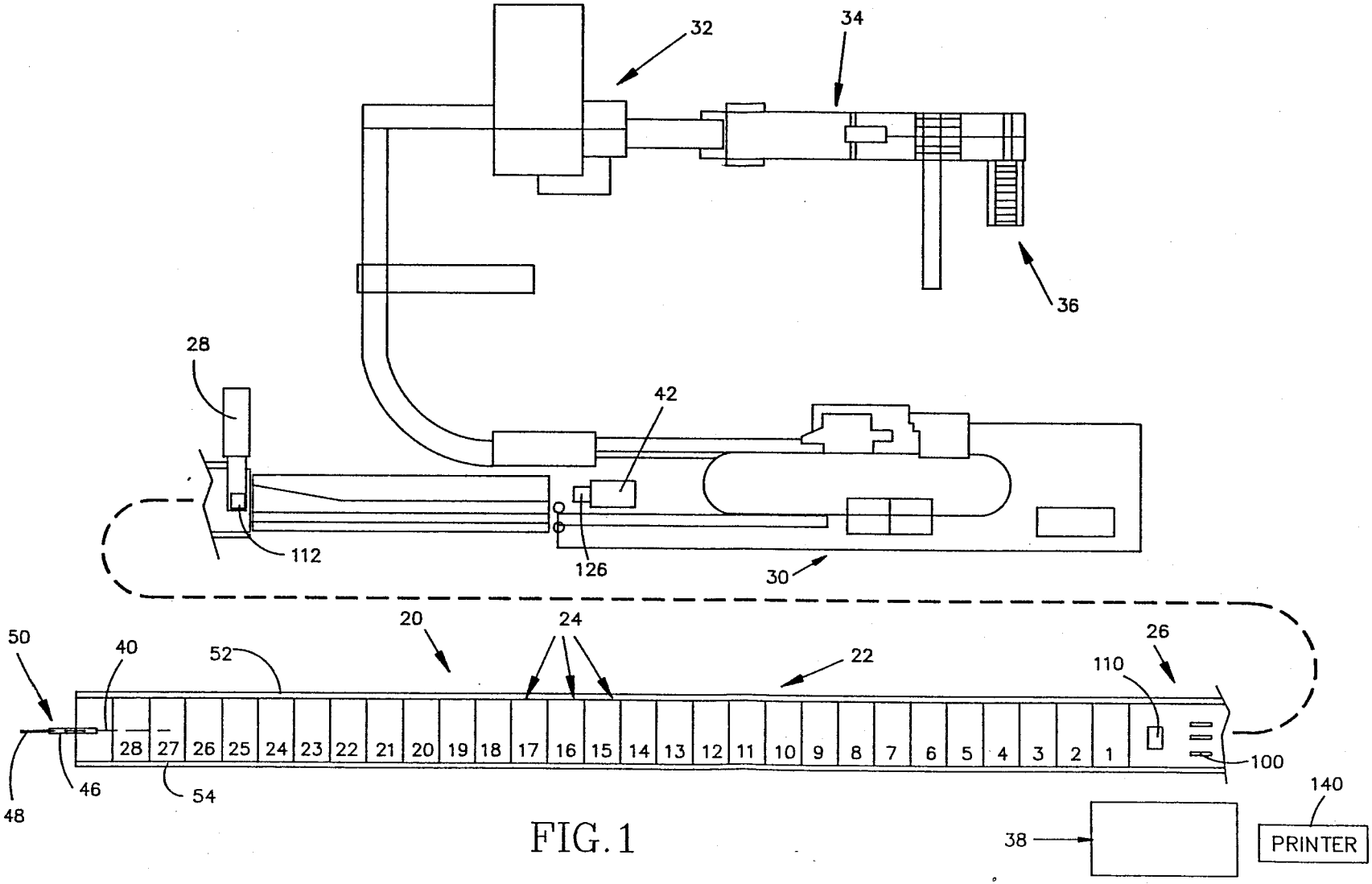
FIG. 1 is a top plan view of a collator/binder system.

Referring to FIG. 1, a collator/bindery system 20 includes a collator section 22 which includes a plurality of hoppers 24 aligned in a linear array. The system 20 further includes a reject station 26 which is used to divert undesired signature assemblages to a reject conveyor 28. The reject conveyor 28 carries rejected signature assemblages away for further handling.

Assembled signatures are glued at a binder station 30 and are trimmed in a trimmer station 32. Mail labels are attached to the assembled signatures at a mail station 34. The assembled signatures are stacked in a stacker 36 for further handling. A control console 38, located adjacent the system 20 and preferably near the reject station 20, electrically controls the operation of the system 20.

Figure 2:
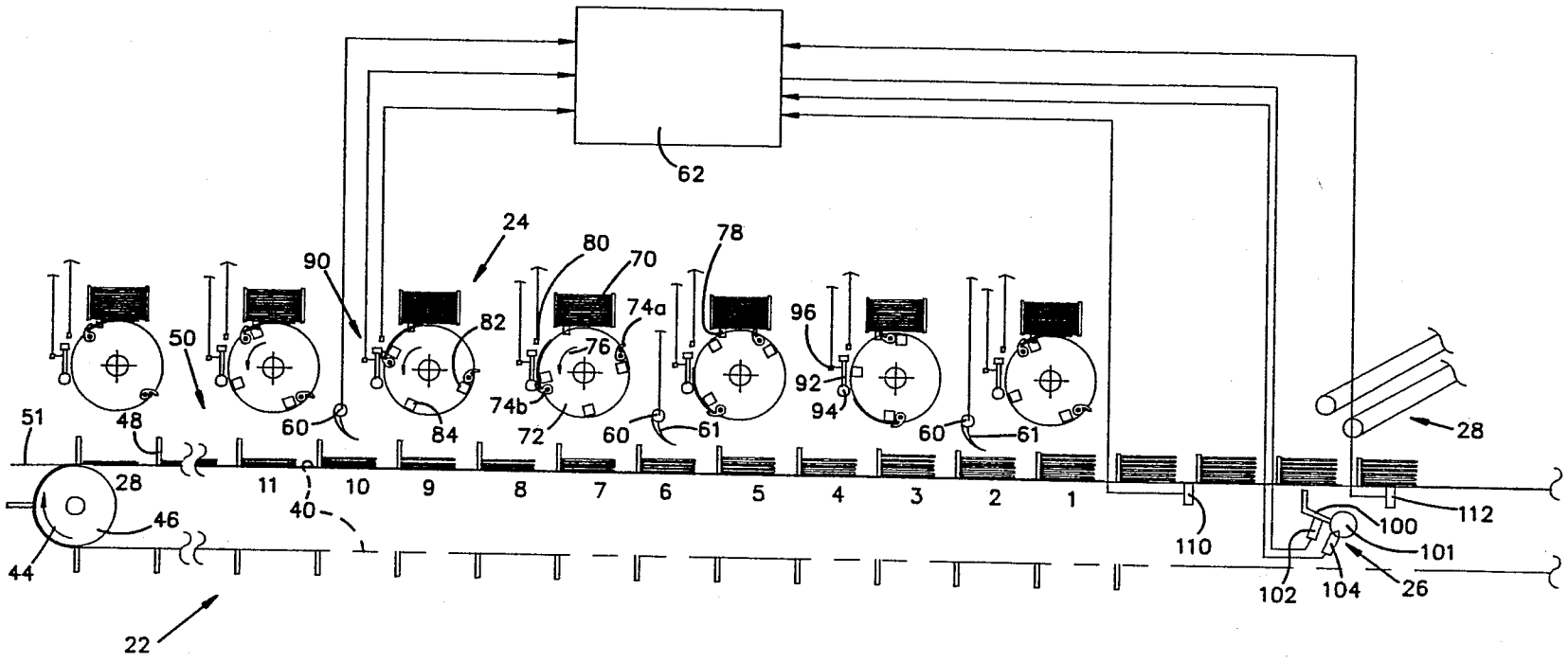
FIG. 2 is a side elevational view schematically depicting the collator shown in FIG. 1.

Referring to FIGS. 1 and 2, a chain 40 is positioned below the hoppers 24 and is driven by a drive motor 42 so that the chain 40 moves in a direction indicated by the arrow 44 on the idler wheel 46.

Chain 40 carries a plurality of spaced apart chain pins 48 which define a plurality of signature feed locations and are used to move the signatures along a raceway 50. The raceway 50 has a bottom wall 51 and spaced apart side walls 52, 54 that run the length of the collator section 22. The side walls 52, 54 are of sufficient height to retain the signatures in the raceway 50. The bottom wall 51 has a centrally located slot to accommodate travel of the chain 40 and pins 48.

Jam detection switches 60 are mounted at spaced apart locations along the raceway 50 and are preferably located between every other hopper 24 within the collator section 22. Each of the jam detection switches 60 are electrically connected to a controller 62 located within the control console 38. Such jam detection switches are well known in the art and are, therefore, not described in detail herein.

Basically, a jam detection switch 60 is a lightly, spring-biased, electrical switch having an actuation lever 61 extending downward toward the signatures in the raceway 50. The end of the actuation lever 61 is approximately at the same elevation as the top of the chain pins 48. When the actuating lever 61 of a jam detector switch 60 encounters a signature that has been incorrectly fed down to raceway 50, e.g., overlying the top of one of the chain pins 48, its associated switch contacts close. When the switch contacts close, the jam switch is said to be actuated. The controller 62 monitors each of the jam switches 60 and detects the occurrence of switch contact closure, i.e., the occurrence of a signature jam.

Each of the hoppers 24 are similarly constructed. Therefore, only one hopper is described in detail. The hopper 24 includes a bin 70 for storing a plurality of signatures. Each of the hoppers typically includes signatures which are different from the signatures of the other hoppers in the collator section 22. A feeder drum 72 is disposed below the bin 70. Fingers 74 are operatively secured to the drum 72 and are disposed near the outer surface of the drum. For purposes of explanation only, the feeder drum 72 has two fingers **74*a*, 74*b*** located diagonally opposite from each other on the drum. Those skilled in the art will appreciate that a feeder drum having three spaced apart fingers or any other combination can be used.

A suction device 78 is located at the bottom of the bin 70. The feeder drum 72 is driven in rotation by the main drive motor 42 in a known manner. As the feeder drum 72 rotates in a direction indicated by arrow 76, the suction device moves upward to pull a single signature downward. A separator dish, not shown, retains the other signatures in the bin. As the drum 72 continues to rotate, the fingers 74 close and grab the pulled down signature. The fingers 74 secure the signature to a block 77 and pull the signature from the bin 70. One such hopper arrangement is fully disclosed in U.S. Pat. No. 3,702,187 to Hageman et al., which is hereby fully incorporated herein by reference. As the feeder drum 72 continues to rotate, the signature is retained against the drum's outer surface and is fed toward the moving chain 40. After sufficient rotation, the fingers 74 open and the signature drops into a feed location on the moving chain 40. Such a signature feed arrangement is fully disclosed in U.S. Pat. No. 3,825,247 to Fernandez-Rana et al., which is hereby fully incorporated herein by reference.

Figure 3:
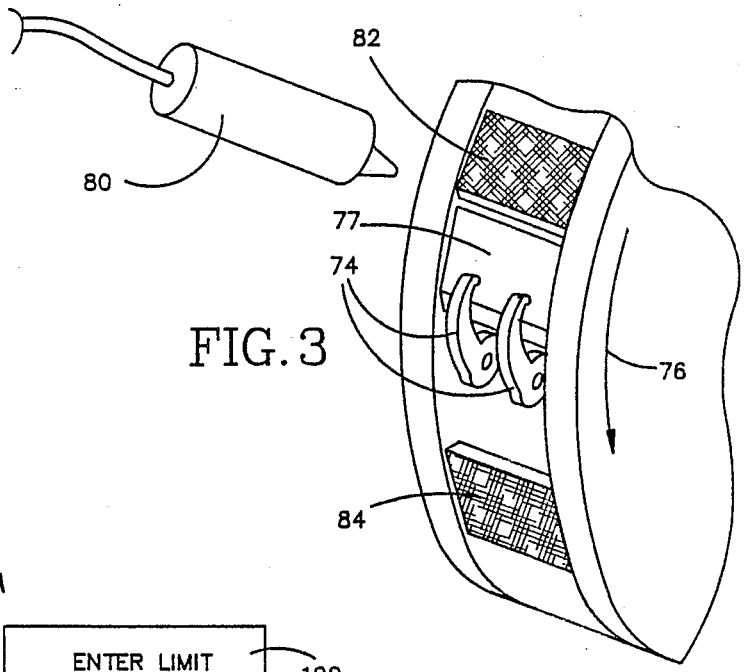
FIG. 3 is an enlarged view of a portion of a hopper drum, some parts of which have been removed for clarity.

An optical sensor switch 80 is used to detect whether or not the fingers 74 have grabbed a signature as the fingers revolve past the bin 70. Referring to FIG. 3, the optical sensor switch 80 shines a beam of light down onto the feeder drum 72. A miss reflector 82 is located on the downstream side of associated fingers 74. The reflector 82 is a corner cube-type that passes a reversed polarized light back to the sensor 80. When the fingers 74 grap a signature from the bin 70, the signature is retained against the drum's outer surface and covers the miss reflector 82.

The optical sensor switch 80 is electrically connected to the controller 62 and is in one electrical state when the light is refelected from a reflector, i.e., the reflector is not covered, and a second electrical state when no reflection is received, i.e., the reflector is covered. If the fingers fail to grap a signature from the bin 70, the optical sensor 80 will receive a reflection from the miss reflector 82. The controller 62 monitors the sensor 80 and is thereby "informed" of whether a signature feed miss has occurred.

A miss verifying reflector 84 is secured to the feed drum 72 at a location relative to the fingers so as to ensure that it is not covered when a maximum size signature is fed by the hopper. The miss verify reflector is also a corner cube-type reflector that passes a reversed polarized light back to the sensor 80. Once each revolution of a feed drum 72, the sensor switch 80 detects a reflection from the miss verify reflector which is, in turn, detected by the controller 62.

Referring to FIG. 2, each hopper has an associated caliber switch assembly 90 mounted adjacent to its drum 72. The caliber switch assembly includes an arm 92 and wheel 94 that is spring biased against the feeder drum 72. A switch 96 contacts the arm 92 and is electrically connected to the controller 62. The caliber assembly 90 monitors the thickness of a signature held to the feeder drum 72 during a signature feed operation as the drum 72 rotates therepast. If more than one signature is being fed the bin 70, the thickness of the signatures cause the arm 92 to move an amount sufficient to close the contacts of switch 96. The controller 62 monitors the condition of switch 96.

The reject station 26 includes a reject arm 100 that is drivable upward through a mechanically driven cam 101 connected to the system main drive. An electrically actuatable hold down device 102 is electrically connected to the controller 62. When it is desired to reject an assemblage, the controller 62 outputs an electrical signal to the actuator 102 to release the arm 100 thereby permitting the arm to move upward, forcing the assemblage into a takeway conveyor 28. A sensor 104 is mounted adjacent to the cam 101 and is electrically connected to the controller 62. The sensor generates an electrical signal indicative of the rotary position of the cam 101.

A learn eye 110 is located on the upstream side of the reject station 26. A book eye 112 is located on the downstream side of the reject station 26. The learn eye 110 and the book eye 112 can be either optical sensors or proximity sensors. The learn eye 110 and book eye 112 each generate one electrical signal when a signature assemblage is at their respective locations, and a second electrical signal in the absence of a signature assemblage at their respective locations. The learn eye 110 and the book eye 112 are electrically connected to the controller 62.

Figure 4:
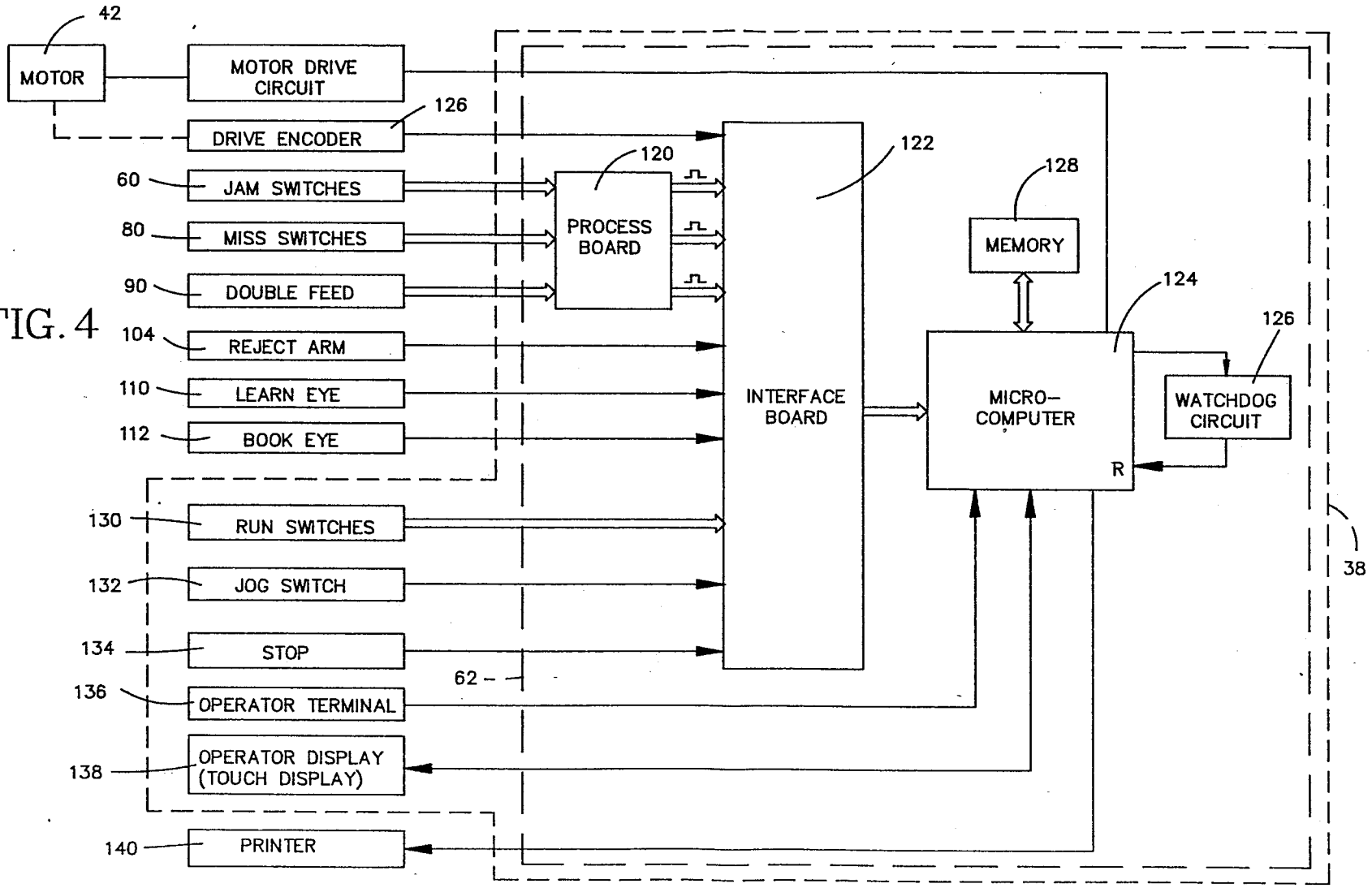
FIG. 4 is a block diagram of control circuitry for use in the present invention.

Referring to FIG. 4, the controller 62 includes a signal processing board 120 electrically connected to each of the jam sensor switches 60, the miss sensor switches 80, and the double feed sensor switches 90. The processing board 120 outputs electrical signals to an interface board 122 when any of the sensor switches 60, 80, 90 are actuated. The processing board 120 outputs a pulse of a predetermined duration upon the sensed occurrence of either a signature jam, a signature miss, i.e., no feed of a signature, or a double feed of a signature.

A microcomputer 124 is electrically connected to the interface board 122. A watchdog circuit 126 is electrically connected to the microcomputer 124. The use of watchdog circuits in combination with a microcomputer or a microprocessor are well known in the art and therefore will not be described herein. A nonvolatile memory 128 is electrically connected to the microcomputer 124.

A drive encoder 126 is operatively connected to the main drive motor 42 and outputs a digitally coded signal indicative of the rotary position of the motor 42 which is, in turn, indicative of the position of the chain 40. The drive encoder 126 is electrically connected to the microcomputer 124 through the interface board 122.

The reject arm cam sensor 104, the learn eye 110, and the book eye 112 are electrically connected to the microcomputer 124 through the interface board 122. The control panel 38 includes a plurality of switches, including run switches 130, a jog switch 132, and a stop switch 134. Each of the switches 130, 132, 134 are electrically connected to the microcomputer 124 through the interface board 122. The control panel 38 further includes an operator terminal 136, such as a keyboard electrically connected to the microcomputer 124. An operator touch display 138 is electrically connected to the microcomputer 124. The touch display 138 allows the microcomputer to display information to the operator and permits an easy way for the operator to enter information to the microcomputer by simply touching the display screen in appropriate locations prompted by a system software program. Such touch displays are well known in the art and will not be described in detail herein. A printer 140 is electrically connected to the microcomputer 124 for the purpose of providing a hard copy of system data.

Figure 5A:
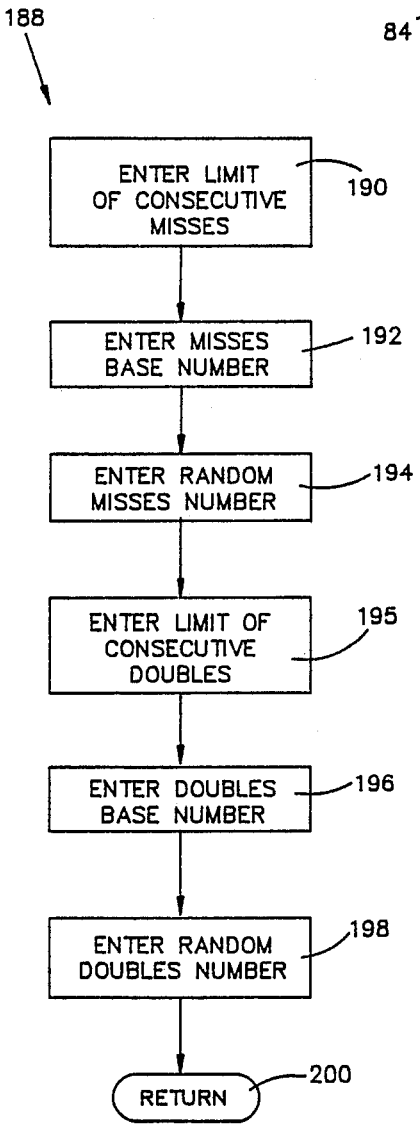
FIGS. 5, 5A, 5B, 5C, 5D, 5E, 6A, 6B, and 7–8 are flow charts depicting system operation of the collator in accordance with the present invention.
Figure 5B:
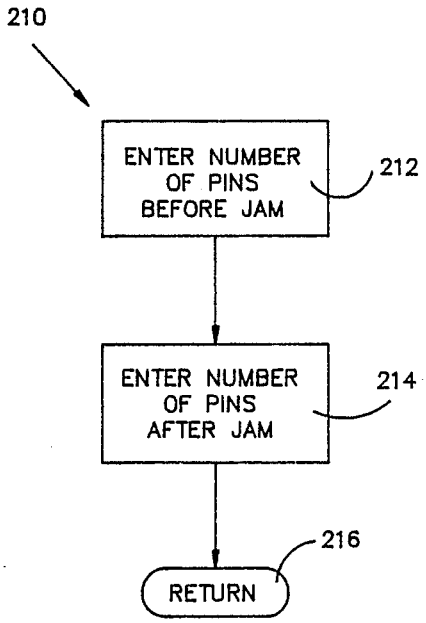
Figure 5:
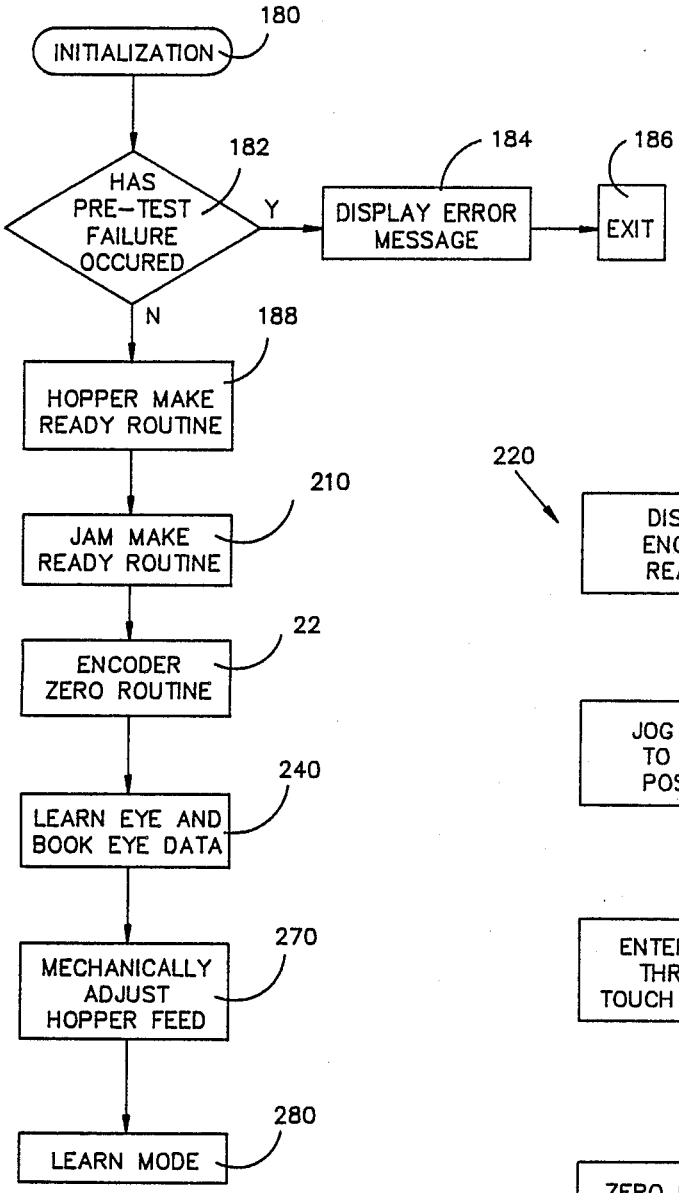

Referring to FIG. 5, the flow chart depicts the process followed for the set up of the collator system in accordance with the present invention. The set up routine is also referred to as the system make-ready routine. In step 180, the electronics are initially energized. The microcomputer 124 performs a plurality of memory tests, determines whether all circuit boards are present, and determines whether the nonvolatile memory is functioning correctly. Such pretests are well known in the art and are referred to as system self-diagnostic tests. In step 182, a determination is made as to whether any pretest failure has occurred. If a failure has occurred, the determination in step 182 is affirmative and an error message is displayed on the display 138 in step 184. The microcomputer system program then exits in step 186. If no failure has occurred in the pretest, the determination in step 182 is negative and the process proceeds to one of a plurality of system make-ready routines. The make-ready routines can be performed in any order FIG. 5 depicts one sequence for explanation purposes only. Preferably, a make-ready menu is displayed on the touch display 138 and the operator selects one of the make-ready procedures to be performed.

A hopper make ready routine is performed in step 188. The purpose of the hopper make ready routine is to enter certain operating limits into the controller's memory for each of the hoppers. In one embodiment of the present invention, the hopper closest to the reject station has its operating limits entered first. Limits for each of the other hoppers is entered, in accordance with a preferred embodiment, in a consecutive manner.

In FIG. 5A, the hopper make ready routine 188 for a hopper is shown. In step 190, the operator enters a limit for consecutive misses for that hopper. In step 192, the operator enters a misses base number to be used by the microcomputer 124 in establishing a limit for random misses per base number. The base number is equal to a number of collator machine cycles which is equal to a number of signatures fed by the hopper. In step 194, the operator enters the number of random misses for that hopper. The random miss limit per base number for that hopper is then retained by the microcomputer 124. During the operation of the collator, the microcomputer keeps track of the number of signature misses by a hopper. When a miss occurs, the microcomputer determines whether or not the total number of random misses per base number of collator machine cycles or signature feeds for that hopper exceeds the set limit.

In step 195, the operator enters a limit for a consecutive number of signature double feeds for that hopper. In step 196, the operator enters a double feed base number. In step 198, the operator enters the random double feed limit per double feed base number. During operation of the collator, the microcomputer keeps track of the number of double feeds by a hopper. When a double feed occurs, the microcomputer determines whether or not the total number of random double feed errors per base number of collator machine cycles or signature feeds for that hopper exceeds the set limit. The consecutive error limit, the random miss limit per misses base number and the double feed limit per double feed base number is set for each of the hoppers in the collator 22. After the limits are set for each of the hoppers, step 200 returns to the routine shown in FIG. 5.

In step 210, a jam make ready routine is performed. Referring to FIG. 5B, the jam make ready routine is shown. This routine is used to establish a signature assemblage reject pattern for use when a signature jam occurs. The reject pattern is defined as the number of chain pin spaces or feed locations before and after the location where the jam occurred that are to be tracked and whose assemblages therein are to be subsequently rejected at the reject station 26. The reject pattern established during the jam make ready routine is done for each of the jam switches separately within the collator. In one preferred embodiment of the present invention, the jam switch located closest to the reject gate has its reject pattern established first.

In step 212, the operator enters the number of feed locations before the jam switch location that are to have their assemblages rejected. In step 214, the operator enters the number of feed locations after the jam switch location that are to have their assemblages rejected. Each of the jam switches may not only have a different before and after limits, but may also different before and after limits from the other jam switches within the collator. After the reject pattern is set for each of the jam switches, step 216 returns to the routine shown in FIG. 5.

Figure 5C:
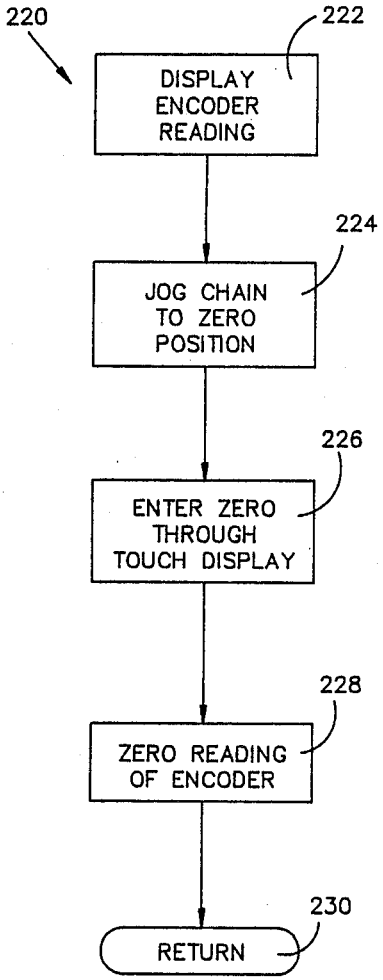

In step 220, an encoder zero routine is performed. Referring to FIG. 5C, the microcomputer displays in step 222 the present reading of the encoder. In step 224, the operator jogs the chain 40 using the jog switch 132 until one chain pin 40 aligns with a permanently fixed mark on the raceway 50. Once a chain pin aligns with the mark on the raceway, the operator, in step 226, tells the microcomputer, through the touch display 138, that the chain is at the zero position. In step 228, the microcomputer uses this reading from the encoder as the zero encoder position or the zero chain position. Each time a chain pin passes the mark on the raceway during operation of the collator, the collator is said to go through a machine cycle. The machine cycle is divided by the microcomputer into degrees such that 360° is equal to one machine cycle. The microcomputer resets the angle to 0° each time a new machine cycle begins. The angular division of the machine cycle is referred to as the encoder angle. If the chain is moved such that chain pins are spaced an equal distance upstream and downstream of the reaceway mark, the encoder reading will be interpreted by the microcomputer as an encoder angle of 180°.

The hoppers feed one signature each machine cycle. Each machine cycle will result in a hopper drum 72 rotating 180°. It will be appreciated that a 180° turn of the drum is a 360° change in the collator machine cycle. Similarly, although the fingers 74 are physically positioned 180° apart on the drum, they are 360° apart in terms of the collator machine cycle. In step 230 the program returns to the routine shown in FIG. 5.

Figure 5D:
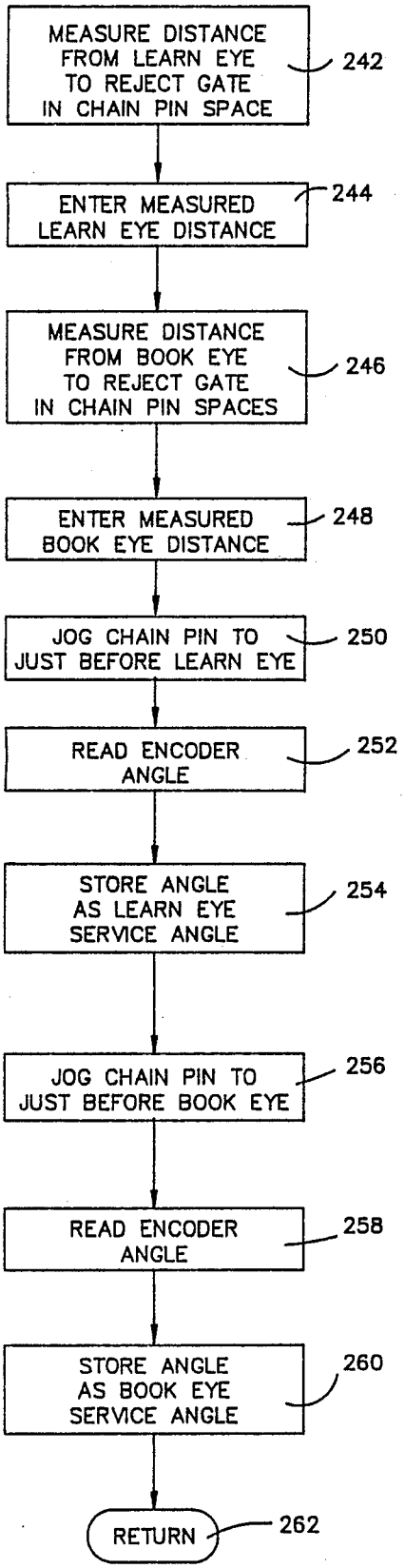

In step 240, learn eye and book eye data are entered. Referring to FIG. 5D, in step 242 of the distance from the learn eye 110 to the reject gate in chain pin spaces (feed locations) is measured by the operator. The reject gate location is taken to be the location where the distal end of the arm 100 comes up to contact signatures on the raceway 50. The measured distance is entered through the keyboard or touch display into the microcomputer's memory in step 244. The distance between the book eye 112 and the reject gate 26 is measured in chain pin spaces (feed locations) by the operator in step 246. The measured distance of the book eye 112 to the reject gate 26 is entered through the keyboard or touch display into the microcomputer's memory in step 248.

In step 250, the chain is jogged until a chain pin is positioned slightly upstream of the learn eye 110. The encoder angle is read by the microcomputer 124 in step 252 and is stored in its memory in step 254 as the learn eye service angle. In step 256, the chain is again jogged until a chain pin is positioned just upstream of the book eye 112. The encoder angle is read in step 258 and is stored in the microcomputer's memory in step 260 as the book eye service angle. The program returns, in step 262, to the routine shown in FIG. 5.

In step 270, each of the hoppers is mechanically adjusted so that a maximum size signature can be fed into a feed location on the chain 40 so that the signature extends to a maximum downstream location within the feed location, i.e., between consecutive chain pins. It is well known in the collator art that each hopper can be mechanically disconnected from the system main drive so as to permit rotation of the hopper drum by hand. Such hand rotation of the drum is known in the art as phasing the hopper. In an array of hoppers, the phase angle of a hopper is different than the phase angle of its adjacent upstream and downstream hoppers.

Figure 5E:
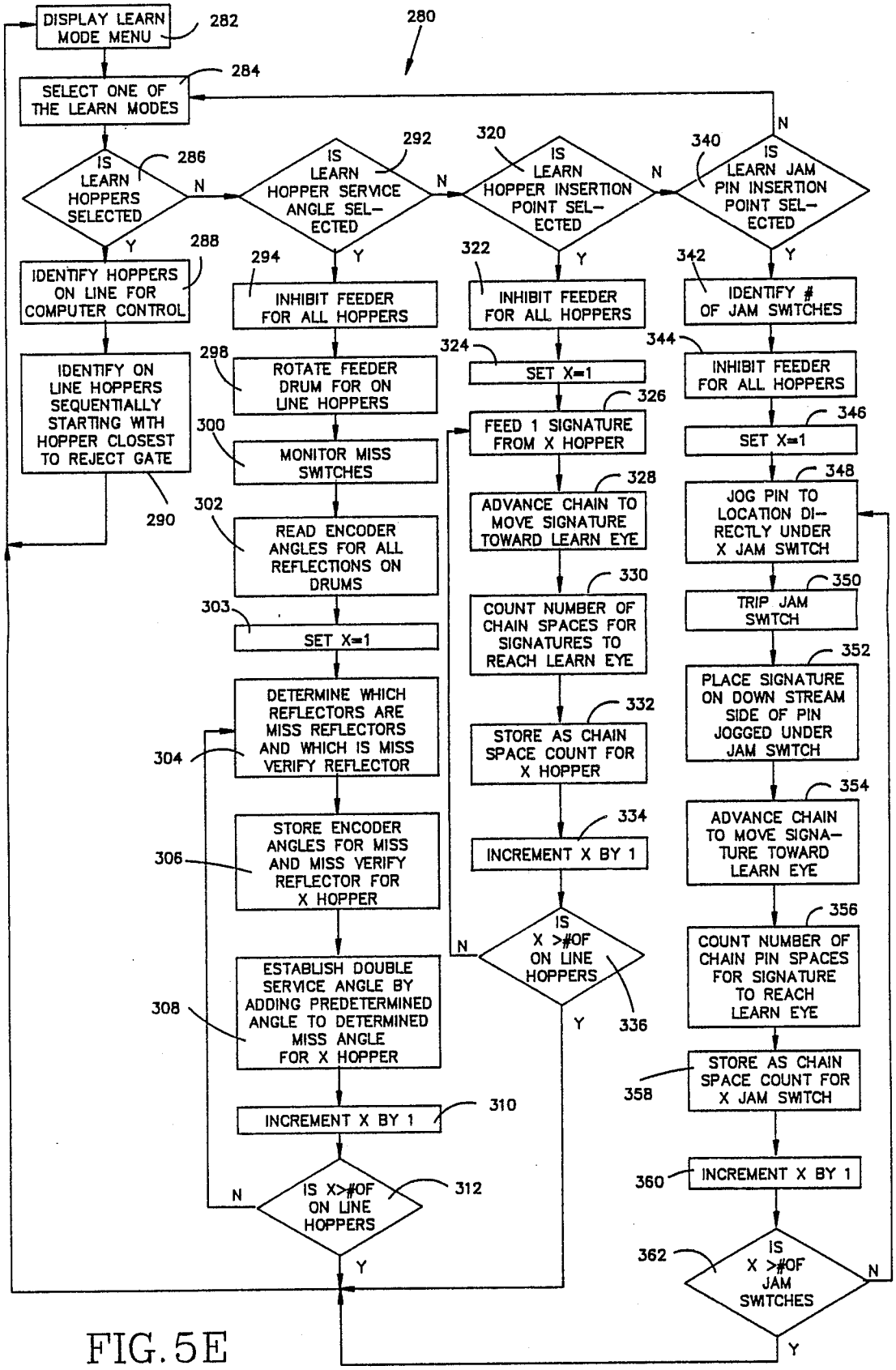

In step 280, the microcomputer performs a learn mode. Referring to FIG. 5E, the learn mode begins in step 282 with the microcomputer displaying on the operator touch display 138 a learn mode menu. The learn mode menu includes four possible learn mode selections, i.e., (i) learn hoppers, (ii) learn hopper service angle, (iii) learn hopper insertion point, and (iv) learn jam switch insertion point. In step 284, the operator, using the touch display, selects one of the learn modes displayed on the learn mode menu.

In step 286, a determination is made as to whether learn hoppers has been selected. If the determination in step 286 is affirmative, each of the hoppers on-line for computer control are identified. Each of the hoppers preferably has an associated switch (not shown) connected to the controller that in one condition will permit computer control and in another condition will not permit computer control. In step 290, each of the hoppers that are on line for computer control are sequentially numbered beginning with the on-line hopper closest to the reject gate as the number one hopper. The on-line hoppers upstream therefrom are sequentially numbered. The program then returns to the display learn mode menu in step 282.

If the determination in step 286 is negative, a determination is made in step 292 as to whether learn hopper service angle has been selected in step 284. If the determination in step 292 is affirmative, the program proceeds to step 294 where the feeder for all hoppers are inhibited. To inhibit a feeder, it is well known in the art to simply shut off the vacuum of the suction device 78 that pulls a signature downward from the bin 70 so that the fingers 74 on the drum 72 cannot grab the signature as the drum rotates. In step 298, the feeder drum for each of the hoppers is rotated. Because no signatures are on the drums 72, the sensor switch 80 for each of the hoppers will trip each time a miss reflector 82 or the miss verify reflector 84 passes thereby. In step 300, the miss sensor switch 80 for each of the on-line hoppers are monitored. In step 302, the microcomputer 124 reads the encoder angles for all reflections received from the reflectors secured to all the on-line drums. In step 303, the microcomputer establishes a value $X=1$.

From hopper X's monitored encoder angles, the microcomputer 124 determines, in step 304, which reflectors are miss reflectors and which one of the reflectors is a miss verify reflector. The two miss reflectors are physically positioned 180° apart on the drum 72 since the drum 72 feeds two signatures per 360° revolution of the drum, each 180° rotation of the drum is 360° of the collator machine cycle. Therefore, the miss reflectors are 360° apart in terms of the collator machine cycle. Since the two miss reflectors are 360° apart, it can be determined which are the miss reflectors and which one is the miss verify reflector. The program stores the encoder angles for the miss reflectors and the miss verify reflector for the first on-line hopper in step 306.

The program, in step 308, establishes a double service angle for the double sensor switch 90 for hopper X by adding a predetermined angle to the determined miss angle for the first on-line hopper as determined in step 304. This is done because the double sensor switch 90 is a known angular distance from the miss sensor switch 80.

In step 310, the value X is incremented by one. A determination is made in step 312 as to whether X is greater than the number of on-line hoppers determined in step 288. If the determination in step 312 is negative, the program returns to step 304 where the second on-line hopper has its service angles determined. The above loop is continued until the determination in step 312 is affirmative at which time the program returns to step 282.

If the determination in step 292 is negative, the program proceeds to step 320 where a determination is made as to whether the learn hopper insertion point has been selected in step 284. If the determination in step 320 is affirmative, each of the feeders for all the hoppers are inhibited in step 322. A value of X=1 is set in step 324 and the program proceeds to step 326 where one signature is fed from the first on-line hopper to a feed location on the chain 40.

The program proceeds to step 328 where the chain is advanced to move the signature toward the learn eye 110. The number of chain spaces (machine cycles) needed to move the signature to the learn eye is counted in step 330 and the count is stored in the microcomputer's memory in step 332 for the first hopper. From this number, the microcomputer determines how far the hopper X is from the reject gate. To do this, the microcomputer adds the learn eye to reject distance entered in step 244 (see FIG. 5D) to the number stored in memory in step 332. This distance is referred to as the hopper insertion point.

In step 334, the value of X is incremented by one. In step 336, a determination is made as to whether or not X is greater than the number of on-line hoppers as determined in step 288. If the determination in step 336 is negative, the program returns to step 326 where a signature is fed from the second on-line hopper. The above-described loop is continued until the determination in step 336 is affirmative, at which time the program returns to step 282.

If the determination in step 320 was negative, the program proceeds to step 340 where a determination is made as to whether the learn jam switch insertion point was selected in step 284. If the determination made in step 340 is affirmative, the program, in step 342, identifies the number of jam switches in the collator. In step 344, all of the feeder hoppers are inhibited. A value of X=1 is set in step 346. In step 348, a chain pin is jogged to a location directly under the first jam switch, which is the one located closest to the reject station.

Once a chain pin is aligned with the jam switch, the jam switch is mechanically tripped by the operator in step 350. The operator places a signature on the downstream side of the pin which was positioned under the jam switch in step 352. The chain is advanced in step 354 to move the signature placed on the chain toward the learn eye. The microcomputer counts the number of chain pin spaces (machine cycles) which are moved to have the signature reach the learn eye in step 356.

In step 358, the number of chain pin spaces counted in step 356 is stored as a count for the jam switch X. From this value, the microcomputer determines the location of the jam switch X from the reject gate. To do this, the microcomputer adds the learn eye to reject distance entered in step 244 (see FIG. 5D) to the number stored in memory in step 358. The distance from the jam switch to the reject gate is the jam switch insertion point. The value of X is incremented by one in step 360. A determination is made in step 362 as to whether the value X is greater than the number of jam switches identified in step 342. If the determination in step 362 is negative, the program returns to step 348 wherein a chain pin is jogged to a location directly under the second jam switch. The above-described loop is continued until a determination in step 362 is affirmative, at which time the program returns back to step 282.

If the determination in step 340 is negative, the program returns to step 284 and the above described loop is again performed. One option displayed in the learn mode menu is EXIT which the operator can select to exit from the learn mode. Once all the routines shown in FIG. 5 are completed, the collator system is ready for operation.

Figure 6A:
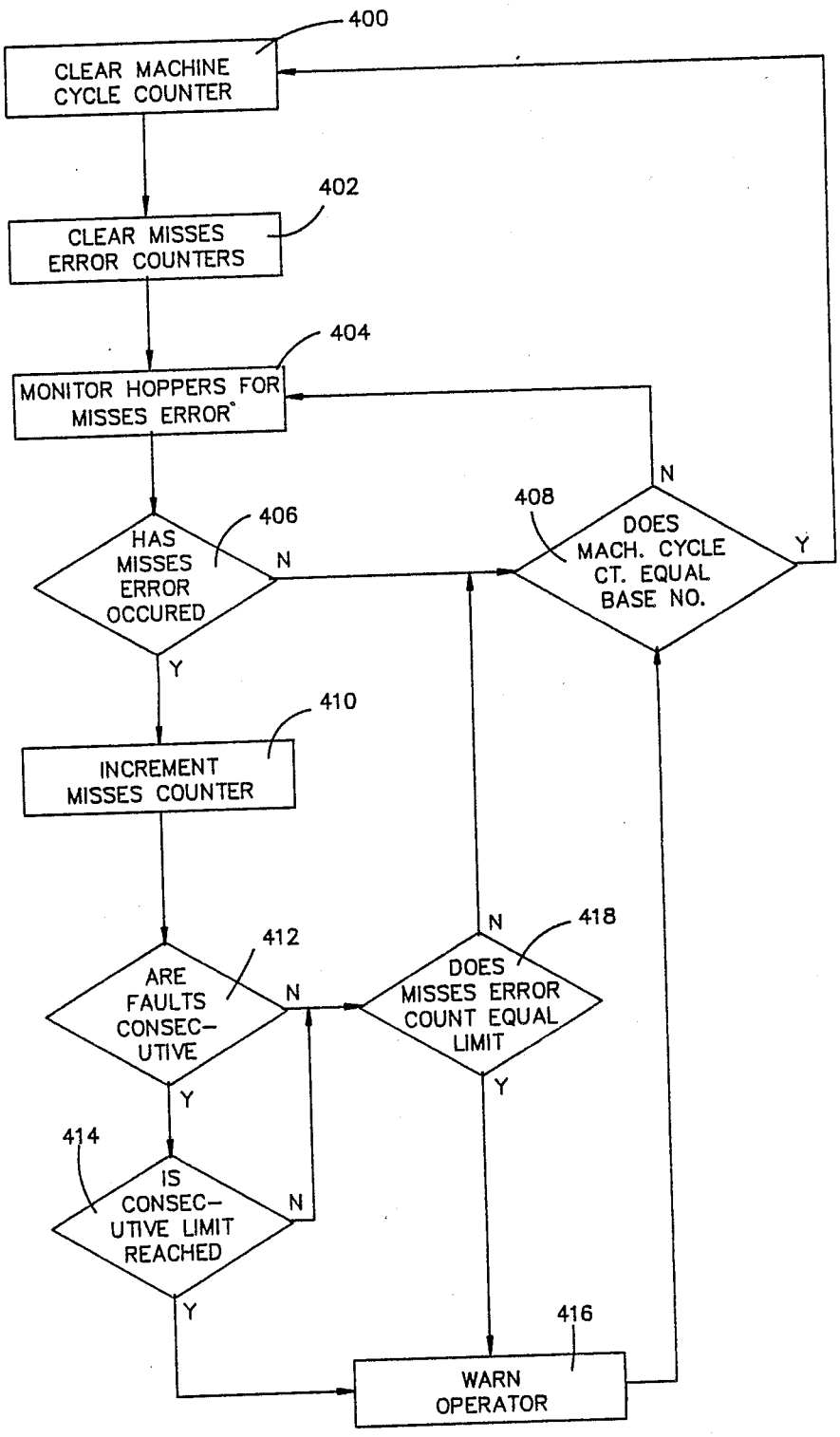

The microcomputer 124 includes a program to monitor, during operation of the collator, the number of miss faults and double feed faults for each of the hoppers. Referring to FIG. 6A, a flow chart is shown depicting a process for monitoring random miss faults for each of the hoppers in accordance with a preferred embodiment of the present invention. As mentioned above, each time a chain pin reaches the mark on the raceway, a machine cycle is completed. As the machine cycle is completed, the machine cycle angular reading is reset to zero. The microcomputer 124 includes a machine cycle counter that counts the number of machine cycles. Also included in the microcomputer is a plurality of miss counters for the hoppers, each hopper having an associated miss counter. A miss counter counts the number of missed signatures as detected by the miss sensor switch 80 for that hopper. The program in step 400 clears the machine cycle counter in the microcomputer 124. In step 402, the misses error counter for each of the hoppers is cleared. In step 404, each of the hoppers is separately monitored for a signature miss during operation. Since the microcomputer 124 has "learned" the service angle of each hopper, i.e., the angle at which the miss reflectors 82 pass the miss sensor switch 80, the microcomputer "knows" when to monitor for the miss signal for each hopper during a machine cycle.

As mentioned, the processing board 120 includes a pulse conditioner connected to the miss sensor switches. The pulse conditioner outputs a pulse to the microcomputer 124 through the interface board 122 having sufficient duration to permit the microcomputer 124 time to monitor the occurrence of a miss signal during a machine cycle.

In step 406, a determination is made as to whether or not a miss error has occurred for any of the hoppers during the machine cycle. If the determination in step 406 is negative, the program proceeds to step 408. In step 408, a determination is made as to whether or not the number of completed machine cycles is equal to the misses base number which was programmed for the hopper being considered as was entered in step 192 (see FIG. 5A). If the determination in step 408 is negative, the program returns to step 404 where the microcomputer continues to monitor the hoppers for misses. Each of the hoppers is monitored for a miss feed one time each machine cycle.

If the determination in step 406 is affirmative, the program in step 410, increments the misses counter by one for the hopper in which the miss occurred. The program then proceeds to step 412 where a determination is made as to whether or not the misses fault detected for a particular hopper is a consecutive fault, i.e., a fault has occurred in the previous machine cycle for the same hopper. If the determination in step 412 is affirmative, a determination is made in step 414 as to whether or not the consecutive fault limit for that hopper as set in step 190 (see FIG. 5A) has been reached. If the determination in step 414 is affirmative, the program proceeds to step 416 where a warning is given to the operator. The operator upon being warned decides whether to stop the collator by depressing the stop switch 134.

If the determination made in steps 412 or 414 are negative, the program proceeds to step 418 where a determination is made as to whether the number of misses error for a hopper equals the limit as set in step 194 (see FIG. 5A). If the determination in step 418 is affirmative, the program proceeds to step 416. From step 416 or from a negative determination in step 418, the program proceeds to step 408. When the determination in step 408 is affirmative, the program returns to step 400 where the machine cycle count is cleared and the program begins again. It will be appreciated that if the number of misses are consecutive and equal to the consecutive limit preset by the operator or if a number of random miss errors occurs per base number greater than the limit preset by the operator for any hopper, a warning is given to the operator. Each hopper is monitored separately and therefore can have its own consecutive limits and its own number of random limits per its own base number.

Figure 6B:
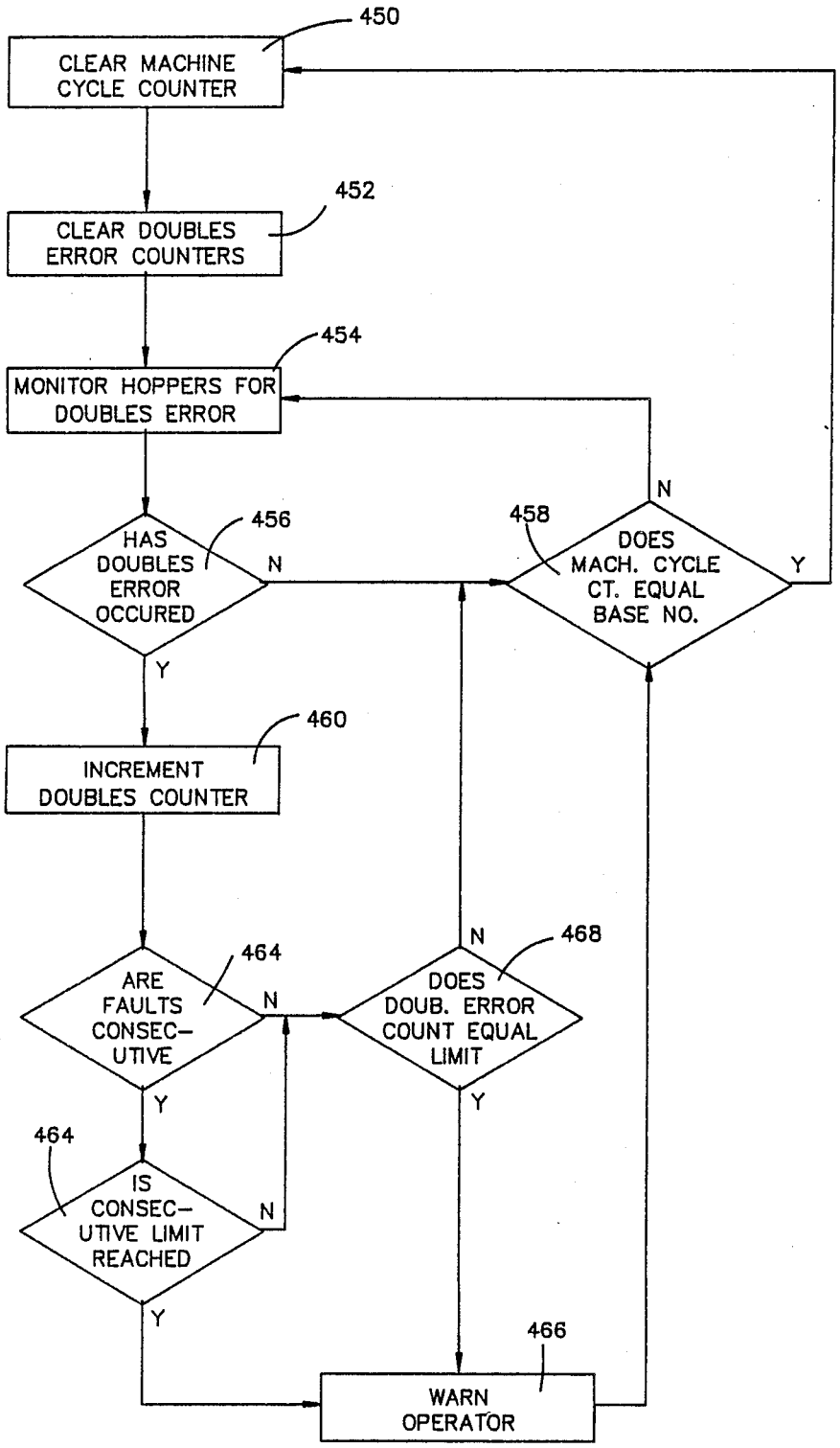

Referring to FIG. 6B, a flow chart is shown depicting a process, in accordance with the present invention, for monitoring double feed faults in each of the hoppers during operation of the collator. In step 450, the machine cycle counter is cleared. Although this step 450 is shown separately in FIG. 6B, it will be understood that this step is the same as step 400 shown in FIG. 6A. The microcomputer 124 further includes a counter for each hopper that counts the number of double feed signals that occur for their associated hopper. In step 452, each of the counters for counting the number of double feeds for each hopper is cleared. In step 454, each of the hoppers double switches 96 are monitored for a double feed fault. The double feed sensor service angle for each hopper was established by the microcomputer 124 based from the determined associated miss sensor service angle plus a predetermined angular degree. Based upon the established double feed service angle, the microcomputer 124 knows when to monitor for a double feed during a machine cycle. The double switches are connected to the microcomputer 124 through the processing board 120 and interfacing board 122. The processing board generates a pulse when a double feed occurs having a predetermined duration sufficiently long to permit the microcomputer 124 time to monitor that a double feed has occurred during any machine cycle.

In step 456, a determination is made as to whether or not a double feed has occurred. The doubles sensor switch 90 for each of the hoppers is monitored one time each machine cycle. If the determination in step 456 is negative, the program proceeds to step 458. In step 458, a determination is made as to whether or not the machine cycle count equals the base number preprogrammed in for the monitored hopper in step 196 (see FIG. 5A). If the determination in step 458 is negative, the program returns to step 454 and the microcomputer continues to monitor the hoppers. If the determination in step 458 is affirmative, the program returns to step 450.

If the determination in step 456 is affirmative, the program proceeds to step 460 where the counter for a double feed is incremented by one for the hopper monitored to have an error. The program then proceeds to step 462 where a determination is made as to whether or not there are consecutive faults, i.e., a double fault has occurred in the previous machine cycle for the same hopper. If the determination in step 462 is affirmative, the program proceeds to step 464 where a determination is made as to whether the consecutive double fault limit for that hopper entered in step 195 (see FIG. 5A) has been reached.

If the determination in step 464 is affirmative, the program proceeds to step 466 where a warning is given to the operator. The operator, when warned, can decide whether to stop the collator using the stop switch 134. If the determination in steps 462 or 464 are negative, the program proceeds to step 468 where a determination is made as to whether the double fault count for the hopper having the error is equal to the limit established in step 198 (see FIG. 5A). If the determination in step 468 is affirmative, the program proceeds to step 466. The program proceeds from step 466 or from a negative determination in step 468 to step 458. In step 458, a determination is made as to whether the machine cycle count is equal to the base number for that hopper entered in step 196 (see FIG. 5A). Each of the hoppers can have its own consecutive fault limit, as well as its own double fault limit and its own doubles base number.

Figure 7:
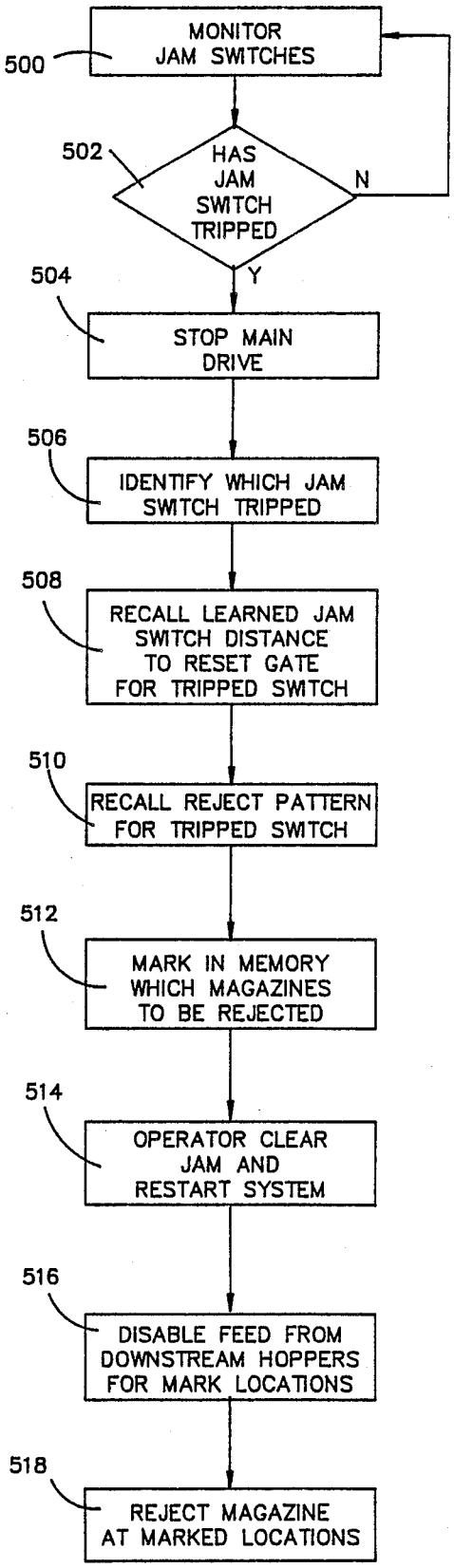

FIG. 7 shows a flow chart describing a process for controlling the collator in response to a monitored jam. In step 500, each of the jam switches within the collator are monitored. In step 502, a determination is made as to whether or not one of the jam switches has tripped. A jam occurs when a signature is fed down to the raceway and, instead of falling between chain pins, falls on and covers a chain pin. If the determination in step 502 is negative, the program returns to step 500 and continues to monitor the jam switches. The jam switches are preferably monitored continuously during each cycle. The jam switches are electrically connected to the microcomputer 124 through the processing board 120.

If the determination in step 502 is affirmative, the program proceeds to step 504 where the main drive of the collator is stopped. The location of the jam switch tripped is identified to the operator in step 506. In step 508, the learned distance from the tripped jam switch to the reject gate is recalled from the controller's memory. In step 510, the reject pattern for the tripped jam switch, which was previously entered in steps 212, 214 (see FIG. 5B), is recalled from the controller's memory. The microcomputer, in its memory, marks the feed locations to be rejected based upon the reject pattern recalled in step 510. The operator clears the jam in step 514 and restarts the collator.

The hoppers downstream from the jam location are disabled in accordance with the recalled reject pattern and the marked locations established in step 512. The signatures are rejected in step 518 by the reject gate commensurate with the reject pattern marked in the microcomputer's memory in step 512. It will be appreciated that each of the jam switches can have a reject pattern different from the reject pattern of the other jam switches. The reject pattern downstream cannot exceed the number of feed locations between the jam switch and the reject gate. The book eye 112 is monitored by the controller to ensure that the proper assemblages have been rejected. Otherwise, the controller warns the operator.

Referring to FIG. 2, assume that the collator 22 has been set up such that the controller 62 has learned the hopper positions relative to the reject gate (hopper insertion points), the jam switch positions relative to the reject gate (jam switch insertion points), and the hopper service angles (miss and miss verify service angles, and doubles service angle) for each of the hoppers. The operator can, through the keyboard or a switch (not shown) elect to ripple start the collator. If ripple start is selected, when the collator is started by activating a run switch 130, the controller ripple starts the collator. During a ripple start, all hopper feeds are initially disabled and the drums are rotated. After at least one complete rotation of the drums, the hopper furthest from the reject gate is enabled so as to feed a signature from its bin to a first feed location on the chain 40 while the remainder of the hopper feeders remain disabled from feeding signatures. As the first feed location having a signature on the chain approaches each of the other downstream hoppers, the downstream hoppers are sequentially enabled so as to feed a signature into the first feed location on the chain.

Even though the hoppers are initially disabled from feeding, their drums are driven in rotation by the main drive. During rotation of the drums of the downstream hoppers in a ripple start, the controller 62 monitors the hopper's service angle, i.e., misses angles and miss verify angles. The controller then compares the monitored ripple start service angles with the service angles that was stored in its memory during the initial set-up (learn mode) of the collator for each of the hoppers. It is necessary to monitor the miss and miss verify service angles for each of the hoppers during ripple start, because the phase of any hopper can be changed by the operator.

To change a hopper's phase, the hopper's drum is mechanically disengaged from the main drive, the drum is rotated, and is then re-engaged with the main drive. These hopper phasing adjustments are periodically made by the operator in an attempt to ensure that a signature fed by a hopper drops properly onto the chain relative to the associated upstream chain pin. An adjustment of a hopper's phase may be necessary to compensate for chain stretch that may occur over time. A hopper's phase also may need adjusting when the size of a signature it is presently feeding is different than the signature size that hopper was feeding when the collator was originally set up. As a result of these changes, the controller must automatically adjust to the new hopper timing and possible new hopper machine cycle distance to the reject gate (hopper insertion point).

Referring to FIG. 2, assume that the fifth hopper from the reject gate has a miss service angle of 350° during initial set up of the collator. This means that its miss reflectors 82 pass its associated miss sensor switch 80 when the encoder of the main drive outputs a signal indicative of the machine cycle being at 350°. Also, assume that the initial collator set up has the signature fed by the fifth hopper's drum dropping into location number 9 on chain 40. If, during a collator machine cycle a miss occurs, in the fifth hopper, the controller 62 "knows" that the signature assemblage presently in location number 9 is the assemblage which is missing a signature and is to be rejected.

Now, assume that during the operation of the collator, the operator stops the collator, mechanically phases the drum of the fifth hopper so that the service angle for a miss now occurs at 50° instead of 350°, and restarts the collator with a ripple start. During ripple start after the hopper phase adjustment, the controller monitors that the miss service angle for the fifth hopper has shifted from the 350° angle initially learned during the learn set up, to a new monitored 50° angle. Such a phase shift of the fifth hopper changes the feed location on the chain where its signatures are fed. When the phase for the fifth hopper is 350°, a signature fed therefrom drops into location number 9. When the phase is shifted to 50°, the signature is fed into location number 8. Assume a miss occurs with the fifth hopper phased to 50°. The assemblage with the missing signature is located in feed location number 8 and not in feed location number 9. The controller 62, now "knowing" that the assemblage with the missing signature is in location number 8 and not location number 9, marks location 8 for rejection instead of location 9. Such a feed location re-adjustment occurs when a hopper's phase is changed through 0°.

It is possible, that the operator can change the phase of a hopper to such an extent that the controller 62 could not compensate for such adjustment. If the microcomputer senses such a large phase adjustment during a ripple start, the main drive is disabled and an error message is displayed on the touch display for the operator. Also, the operator can phase a hopper in a wrong direction. Such an occurrence can be detected by the controller so that the controller can disable the main drive.

The miss verify reflector 84 located on each of the drums 72 for the hoppers serves several purposes. First, the miss verify reflector permits the controller to detect that the miss sensors 80 are functional. Once per revolution of the drum 72, the controller 62 should "see" a return signal from each of the sensors 80 indicative of the miss verify reflector 84 passing thereby. If the miss verify reflector is not "seen" by the controller 62, one possible fault could be an inoperative sensor switch 80. The controller would stop the collator if a miss verify sensor is not seen by its associated sensor switch 80. Also, the miss verify reflector 84 provides a way for the controller 62 to determine that the associated drum 72 of each of the hoppers is, in fact, rotating during operation of the collator. Without the miss verify reflector, the drum could otherwise set idle having been disconnected from the main drive without such occurrence being detected by the controller. The absence of a miss verify signal can, therefore, be indicative of a drum not rotating.

Also, it is possible that a signature can get "hung up" in the hopper blocking the associated miss sensor 80 and also preventing further signature feeds from the hopper. Such an occurrence would be detected by the sensor 80 not receiving a signal from the miss verify reflector 84 as it passes thereby.

Furthermore, the miss verify reflector provides a way for the controller 62 to determine whether or not a phase adjustment has been made during operation of the collator, i.e., after ripple start information has been monitored. If an operator should stop the collator during operation, adjust the phase of one of the drums, and restart the collator without a ripple start, the controller would detect the phase shift through the sensor signal received from the miss verify reflector. If the controller 62 does not "see" a return signal from a miss verify reflector when it should because of a change in hopper phase, the main drive for the system is stopped. The operator can restart the controller with a ripple start so that the new hopper service angles can be "learned".

Attached hereto as appendix A is a copy of a software program listing for controlling the touch display 138 in the learn mode. One such touch display is a Fluke 1780A InfoTouch Display. Also, attached hereto as Appendix B is a copy of a software listing for accomplishing the learn mode process described above. The software listings contemplate use of an Omnibyte OB68KlA computer which uses a Motorola 68000 microprocessor based system. It is also contemplated that an OPTO-22 PAMUX II interface be used. The program listings are but one way of accomplishing the process according to the present invention and are not to be construed as a limitatioo to the present invention.

Figure 8:
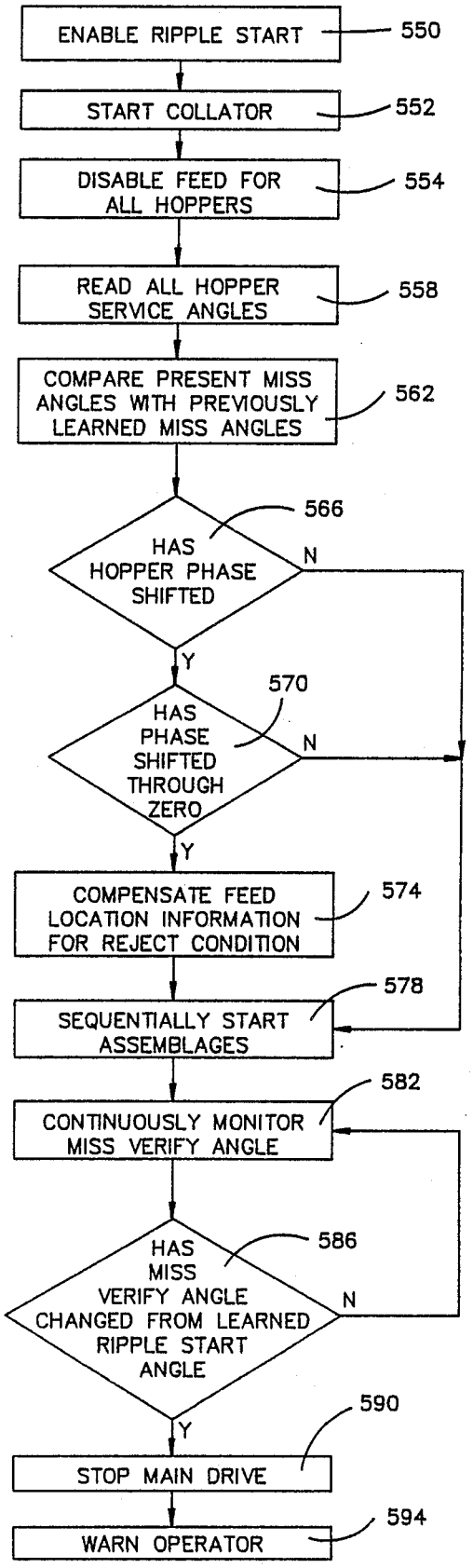

Referring to FIG. 8, a flow chart is shown depicting the control process during ripple start and subsequent monitoring for hopper phase changes that occur aftend the collator is started in step 552. In step 554, the feeders for all the hoppers are disabled. The drums for each of the hoppers is rotated and the angles of each of the miss reflectors and the miss verify reflector is monitored in step 558. In step 562, the miss angles monitored in step 558 are compared against those learned during initial collator set up (step 306, FIG. 5E). A determination is made in step 566 as to whether a hopper phase shift has occurred. If the determination of step 566 is affirmative, the program proceeds to step 570 where a determination is made as to whether the hopper phase shift has gone through zero. If the determination in step 570 is affirmative, the program proceeds to step 574 where the controller compensates its feed location information for reject conditions to allow for the phase shift. In the example discussed above where the phase shift went from 350° to 50°, the process of step 574 changes the feed location information for the fifth hopper, i.e., that the fifth hopper now feeds location 8 instead of location 9.

The program proceeds from step 574 or from negative determinations in either step 566 or step 570 to step 578 where the signature fed from the hoppers is sequentially started. The miss verify angles are continuously monitored in step 582 during collator operation. In each machine cycle, a determination is made in step 586 as to whether the miss verify angle has changed for any hopper after the ripple start angles were monitored in step 558. If the determination in step 586 is negative, the program returns to step 582. If the determination in step 586 is affirmative, the program proceeds to step 590 where the main drive is stopped and the operator is warned in step 594.

This invention has been described with reference to preferred embodiments. For example, the present invention has been described with reference to flat-back assemblages. The method and apparatus of the present invention also applies to saddle collators and newspaper stuffing machines. Modifications and alterations may occur to others upon reading and understanding the specification. It is our intention to include all such modifications and alterations insofar as they come within the scope of the appended claims or the equivalent thereof.

What is claimed is:

1. An apparatus for controlling a collator having a plurality of hoppers adapted for feeding signatures onto a movable conveyor, said conveyor having a plurality of signature feed locations sequentially movable past said hoppers for receiving signatures fed from the hoppers to form assemblages, said apparatus comprising:

means for establishing separately for each of the plurality of hoppers an associated incorrect feed limit value per an associated, predetermined base number of signature feeds;

means for sensing an incorrect feed of a signature from any one of hoppers and for generating a signal indicative thereof;

means for determining if the number of senses incorrect signature feeds for any one of the hoppers sensed to have an incorrect feed has reached that hopper's associated, established incorrect signature feed limit with that hopper's associated, predetermined base number of signature feeds; and means for providing an indication to an operator when the determining means determines that the number of incorrect signature feeds for one of the hoppers has reached that hopper's associated incorrect signature feed limit within that hopper's associated, predetermined base number of signature feeds.

2. The apparatus of claim 1 wherein said means for sensing an incorrect feed of a signature includes means for sensing absence of a signature.

3. The apparatus of claim 2 wherein said means for sensing absence of a signature includes an optical reflector mounted near an outer surface of a rotary drum of a hopper, the rotary drum grabbing a signature and feeding it to a location on the conveyor, the signature, when grabbed by the drum covering the reflector and an optical sensor for sensing light reflected from the reflector as the drum rotates when a signature does not cover the reflector, the optical sensor generating one electrical signal when an uncovered reflector passes thereby and a second electrical signal otherwise.

4. The apparatus of claim 1 wherein said means for sensing an incorrect feed of a signature includes means for sensing the simultaneous feed of two or more signatures.

5. The apparatus of claim 1 further including means for establishing a consecutive incorrect feed limit for each of the hoppers, means for counting the number of consecutive incorrect feeds for each of the hoppers, means for comparing a number of consecutive errors counted for a hopper against the established consecutive incorrect feed limit for such hopper, means for stopping the collator when the comparing means indicates that the number of consecutive incorrect feeds counted has reached the established consecutive incorrect feed limit for any of the hoppers.

6. A method for controlling a collator having a plurality of hoppers adapted for feeding signatures onto a movable conveyor, said conveyor having a plurality of signature feed locations sequentially movable past said hoppers for receiving signatures fed from the hoppers to form assemblages, said method comprising the steps of:

(a) establishing separately for each of the plurality of hoppers an associated incorrect feed limit value per an associated, predetermined base number of signature feeds;

(b) sensing an incorrect feed of a signature from any one of hoppers and for generating a signal indicative thereof;

(c) determining if the number of sensed incorrect signature feeds for any one of the hoppers sensed to have an incorrect feed has reached that hopper's associated, established incorrect signature feed limit within that hopper's associated, predetermined base number of signature feeds; and (d) providing an indication to an operator when it is determined that the number of incorrect signature feeds for one of the hoppers has reached that hopper's associated incorrect signature feed limit within that hopper's associated, predetermined base number of signature feeds.

7. The method of claim 6 wherein the step of sensing includes the step of monitoring each signature feed from each of the hoppers.

8. The method of claim 7 wherein the step of sensing further includes the step of generating a signal indicative of a hopper missing a signature during a hopper feed.

9. The method of claim 7 wherein the step of sensing further includes the step of generating a signal indicative of a hopper simultaneously feeding more than one signature during a hopper feed.

* * * * *